US006193083B1

(12) United States Patent
Wood

(10) Patent No.: US 6,193,083 B1
(45) **Date of Patent: *Feb. 27, 2001**

(54) DISPLAY FIXTURE SYSTEM

(75) Inventor: Graham Robert Wood, Glencoe, IL (US)

(73) Assignee: Stamford Investments, Inc., Wheeling, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/534,659

(22) Filed: Mar. 24, 2000

Related U.S. Application Data

(63) Continuation-in-part of application No. 09/267,521, filed on Mar. 12, 1999, now Pat. No. 6,044,986.

(51) Int. Cl.[7] ..... A47F 5/00

(52) U.S. Cl. ..... 211/87.01; 211/103; 211/189; 211/90.02; 211/90.04

(58) Field of Search ..... 211/103, 90.01, 211/90.02, 90.04, 94.01, 87.01, 105.1, 48, 96, 189; 312/245

(56) References Cited

U.S. PATENT DOCUMENTS 3,814,033 * 6/1974 Rudat et al. .
3,875,711 * 4/1975 Palmer .
4,205,815 * 6/1980 Sauer et al. .
4,832,298 * 5/1989 Metcalf ..... 211/59.1 X
5,027,962 * 7/1991 Maccarrone ..... 211/191
5,292,011 * 3/1994 Kostigian ..... 211/103 X
5,305,898 * 4/1994 Merl ..... 211/87.01
5,472,103 * 12/1995 Merl ..... 211/94.01 X
5,503,277 * 4/1996 O'Brien ..... 211/94.01
5,641,081 * 6/1997 Merl ..... 211/103
5,697,507 * 12/1997 Blass ..... 211/103 X
5,758,988 * 6/1998 Theodorou ..... 211/103 X
5,769,247 * 6/1998 Merl ..... 211/103
5,848,711 * 12/1998 Schmit ..... 211/90.04
5,857,577 * 1/1999 Thomas et al. ..... 211/94.01
6,044,986 * 4/2000 Wood ..... 211/87.01

* cited by examiner

*Primary Examiner*—Robert W. Gibson, Jr.
(74) *Attorney, Agent, or Firm*—Welsh & Katz, Ltd.

(57) ABSTRACT

A display fixture system includes a plurality of vertical support posts each support post having a U-shaped support element and a flange extending from each side thereof in parallel, spaced relation thereto. Pins traversing through the support element are maintained in place by the flanges. The flanges are connected to one another by a connecting member extending across a rear portion of the support element. The support posts support product displays therefrom hung from the pins. Posts are mounted in back-to-back relation to one another to form a freestanding display system. The posts are mounted to upper and lower brackets to provide a wall-mounted display system.

9 Claims, 6 Drawing Sheets

FIG. 13
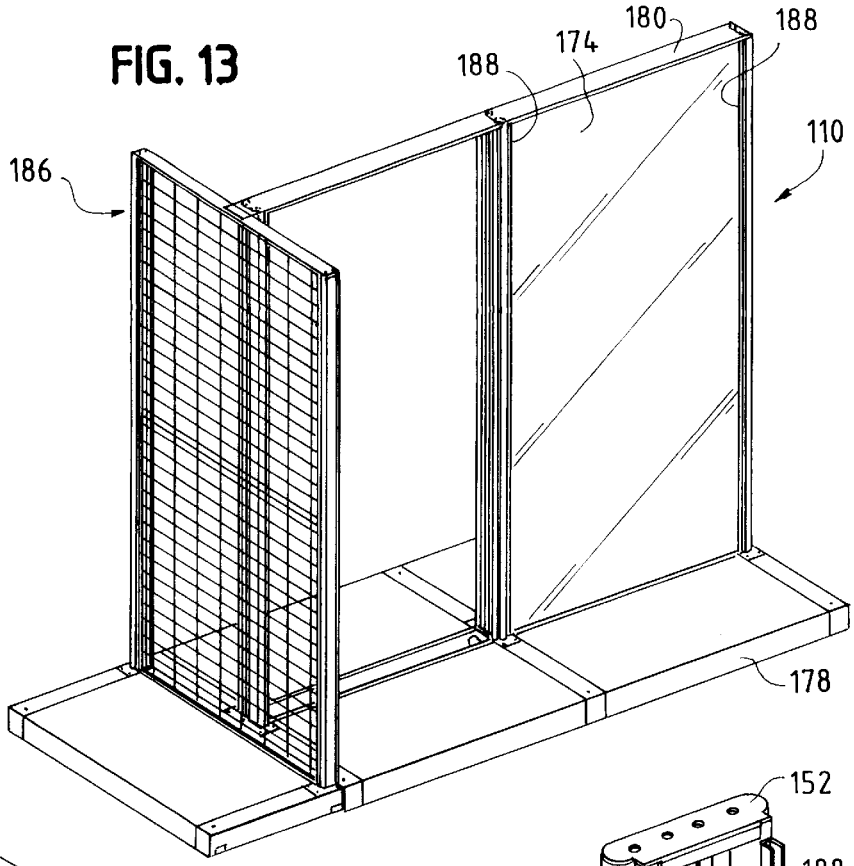
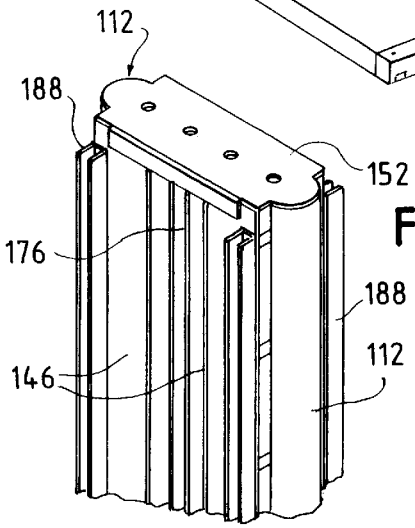
FIG. 14
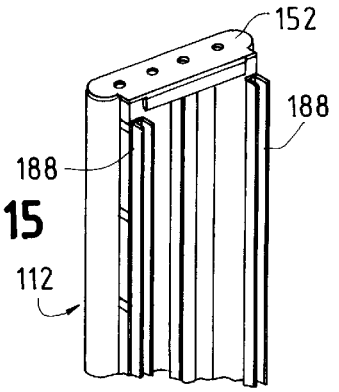
FIG. 15
FIG. 16
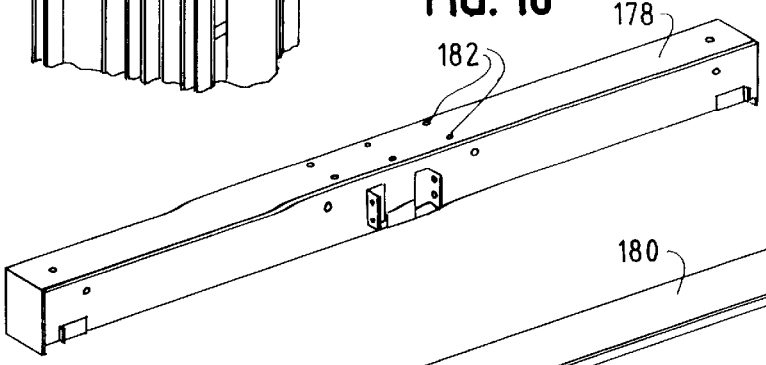
FIG. 17
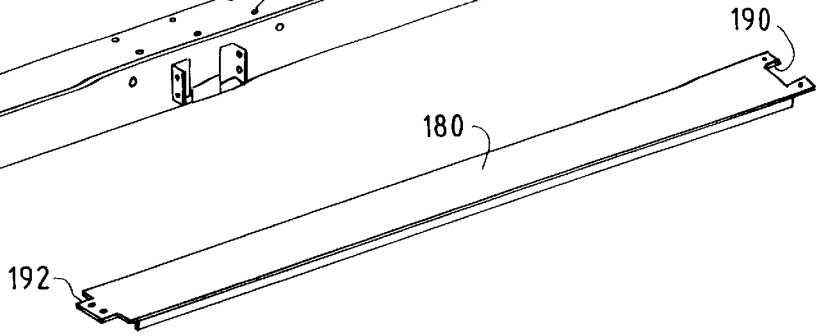

DISPLAY FIXTURE SYSTEM

CROSS-REFERENCE TO RELATED APPLICATIONS

This is a continuation-in-part of U.S. patent application Ser. No. 09/267,521, filed Mar. 12, 1999 now U.S. Pat. No. 6,044,986.

FIELD OF THE INVENTION

This invention pertains to a display fixture. More particularly, the invention pertains to a readily installed display fixture system that can be wall mounted or free-standing such as those used in retail establishments.

BACKGROUND OF THE INVENTION

Display systems are well known in the art. These systems can be used, for example, for retail display of various items such as clothing and the like. Consumers will likely recognize such systems which often include shelves for displaying merchandise and hangers from which items can be displayed or hung. These displays can also include partitions and the like for segregating one particular type of merchandise from another.

One known type of wall display system includes a plurality of vertically oriented, spaced upright posts mounted to the surface or wall. The posts typically include a plurality of evenly spaced elongated slots extending longitudinally therealong. Brackets having hook-like projections extending from a rear end insert into the elongated slots and lock to the posts. The brackets can be used to support shelving, signs, desk surfaces and the like.

One drawback to this type of system is that each of the vertical posts must be separately or independently mounted to the wall surface. While this type of arrangement has gained wide-spread acceptance, it leaves much room for error in layout or design and installation. For example, if adjacent posts are not properly spaced from one another, a shelf that is intended to extend between the posts may be too long or too short for the given installed spacing. In addition, when installing such systems, the height of corresponding slots from one post to an adjacent post must be properly maintained, or the shelf may not rest horizontally planar on the brackets.

Another type of shelving system includes a grid-like arrangement that is mounted to the wall surface. The grid-like arrangement includes a plurality of horizontally extending bars, onto which brackets are attached. While this arrangement overcomes some of the above-noted problems associated with the independent post type of arrangement, the grid-like configuration can be quite large and bulky and, as will be recognized, rather heavy as well. Additionally, the grid-like arrangement, like the independent post arrangement, requires that the grid be mounted to the wall at a large number of locations.

Still another type of display fixture system includes a plurality of essentially free-standing U-shaped vertical standards or uprights. Each of the U-shaped uprights includes a pair of parallel elements, to which shelves and the like can be attached. Although this arrangement provides a significant amount of display space, it is free-standing, and is therefore subject to the instability associated with many such free-standing systems.

Accordingly, there exists a need for a readily installed display fixture system that is wall mounted or free-standing. Desirably, such a system can be readily installed on any flat wall surface, and is secured to the surface using a minimum number of fasteners. Another desirable system is free standing. Most desirably, such a system eliminates the possibility of improperly spacing the vertical uprights from one another and provides adjustability of the vertical support risers to maintain spanning elements, such as shelves, horizontal.

SUMMARY OF THE INVENTION

A display fixture system includes upper and lower, spaced apart, parallel horizontal brackets for mounting to an associated surface. Each bracket has a securing location that corresponds to a securing location of the other bracket. The brackets are mounted to the surface so that corresponding securing locations are vertically aligned with one another.

Support risers extend between and are secured to the brackets. The risers secure between the brackets vertically, transverse to the brackets and spaced from the wall surface. The risers mount to the upper and lower brackets at securing locations on the brackets.

The display system is configured to support product display elements, such as shelves, display surfaces, signs and hangers to, for example, hang clothing, as well as other types of display ornamentation. The system is flexible and sufficiently versatile that using standard posts and brackets, custom displays can be designed and installed quickly and efficiently, with a minimum number of wall fasteners required.

Each of the support posts inserts into corresponding upper and lower bracket securing locations. The support posts are preferably formed having a central support member, such as a tubular element and a pair of longitudinally extending flanges. Pins insert through transverse openings in the support posts and are fastened to the posts and to the flanges to secure the flanges to the posts. In a most preferred configuration, an upper end of each support post includes a threaded bore or insert to facilitate securing the post to the upper bracket.

The upper and lower brackets each include an opening and a pair of elongated slots disposed on either side of the opening for receiving a support post. The flanges insert into the elongated slots and the post inserts through a relatively large opening in the lower flange. A threaded fastener, such as a bolt, is inserted through the opening in the upper bracket and threadedly engages the insert or bore in the post to secure the post to the upper bracket.

In a most preferred embodiment, the support posts each include a height adjusting element, such as a threaded foot for resting the support post on the floor, and to provide height adjustment so that each support post is vertically aligned with its adjacent posts.

The pins that extend from the support posts to the flanges are configured to receive brackets and other hanging elements for hanging shelves, signs, garment hangers, table tops and the like, as well as other types of display ornamentation. Optionally, the display system can include wall panels that mount to the upper and lower brackets, between adjacent support posts. In one embodiment, the panels include fixed lower pins that extend from a bottom edge of the panel frame and biased upper pins that extend from an upper edge of the panel that insert into openings formed in the upper and lower brackets, respectively.

Another embodiment of the invention is configured as a display fixture system which, when mounted to an associated surface, includes upper and lower spaced apart, parallel horizontal brackets for mounting to the surface. Each bracket has a securing locating corresponding to a securing location of the other of the pair of brackets. The brackets are mounted to the surface so that corresponding securing locations are vertically aligned with one another.

A support post extends between and is secured to the brackets. The support post is secured between the brackets in a vertical orientation, transverse to the brackets and spaced from the surface. Each support post includes a support element and a plurality of pins traversing through the support element. Each post further includes a pair of flanges, each extending along a side of the support element and configured to maintain the pins positioned within the support posts. In a preferred embodiment, the support element is formed as a U-shaped member having a pair of elongated leg portions and defining an open end. The flanges are connected to one another by a connecting portion that extends across the open end of the support element. Most preferably, each flange has a portion spaced from and parallel to its respective support element leg portion. In this configuration, the support post flanges secure the pins within the support element.

The upper and lower brackets can include openings therein and the support posts can include upper and lower caps having aligning pins extending therefrom. The aligning pins extend into the openings in the upper and lower brackets to maintain the posts in a vertical orientation and to maintain the posts spatially separated from one another.

Alternately, the display fixture system can be configured as a standalone or gondola-type system. In this embodiment, the support posts are configured in back-to-back relation to one another with the flange connecting members attached to one another. The support posts can be mounted to a base element and an upper element to define a frame for the fixture system. A plurality of pairs of support posts can be mounted to the base and top elements and an end cap can be mounted to the display system perpendicular to a plane defined by the pairs of posts to provide support for the system.

Other features and advantages of the present invention will be apparent from the following detailed description, in conjunction with the accompanying drawings, and the appended claims.

BRIEF DESCRIPTION OF THE FIGURES

FIG. 13 is a perspective view of the alternate embodiment of the display fixture system shown as a free-standing or gondola-type system;

FIG. 14 is a top view of a pair of the support posts in back-to-back relation to one another;

FIG. 15 illustrates the support posts in back-to-back relation to one another and shown with a single flange extending along a side of the support element;

FIG. 16 illustrates an exemplary base element for mounting the stand-alone system; and FIG. 17 illustrates an exemplary top element for mounting the standalone system.

DETAILED DESCRIPTION OF THE PREFERRED EMBODIMENTS

Figure 1:
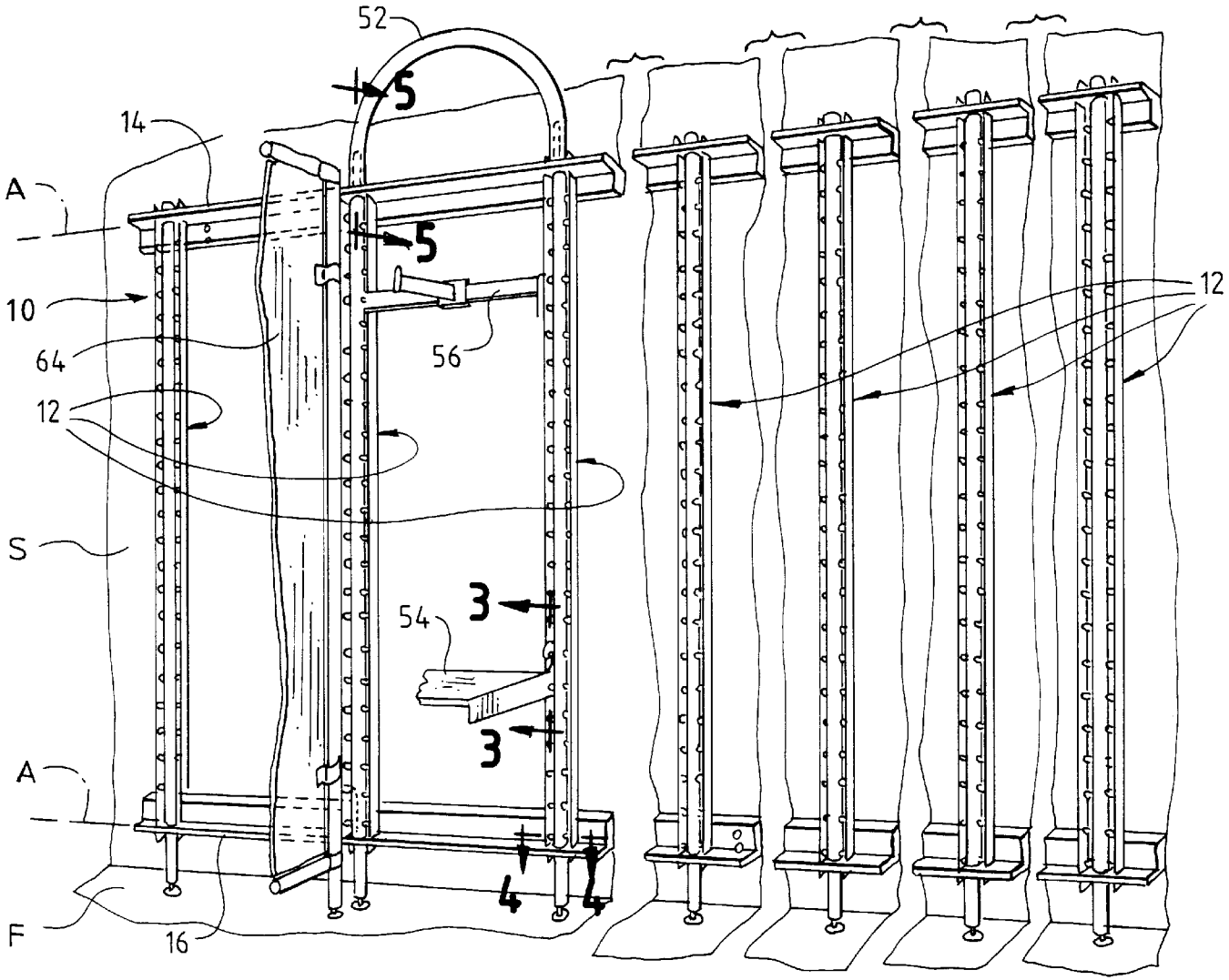
FIG. 1 is a perspective view of a wall mounted display fixture system embodying the principles of the present invention, the system being illustrated in partial view so as to illustrate a plurality of vertical upright posts.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

Referring now to the figures and in particular to FIG. 1, there is shown a wall mounted display fixture system 10 embodying the principles of the present invention. This system includes, generally, a plurality of parallel, vertically extending upright support posts 12 secured between and mounted to upper and lower bracket members 14, 16, respectively. The bracket members 14, 16 are adapted to secure the vertical support posts 12 in spaced parallel relation to one another. In a current embodiment, the upper and lower brackets 14, 16 are angle-like members each having a first leg 18 for mounting the bracket 14, 16 to the wall surface S, and a second leg 20 that is configured for receiving the vertical support posts 12. The brackets 14, 16 can be mounted to the wall S by, for example, threaded fasteners such as screws. It will be appreciated by those skilled in the art that the brackets 14, 16 can be formed in a wide variety of configurations, which configurations are within the scope of the present invention.

The lower bracket 16 includes a plurality of relatively large diameter openings 22, each opening 22 having associated therewith a pair of openings, preferably a pair of symmetrically located elongated slots 24 positioned on opposing sides of the larger, central opening 22. The upper bracket 14 includes a plurality of smaller diameter openings 26, each having a pair of openings, preferably a pair of elongated slots 28 associated with each opening 26 positioned on opposing sides of the smaller diameter opening 26. For purposes of the present discussion each opening and its associated elongated slots will be referred to as a securing location, indicated generally at 30 and 32 for the upper and lower brackets 14, 16, respectively. In a preferred configuration, the elongated slots 24, 28 are formed symmetrically in the brackets 14, 16 relative to the openings 22, 26 and extend transverse to a longitudinal axis A of the bracket 14, 16.

Each of the upper and lower securing locations 30, 32 is spaced a predetermined distance from its adjacent securing locations. As will be appreciated from the drawings, spacing each securing location 30, 32 from its adjacent securing locations establishes a predetermined distance between each of the vertical upright support posts 12. In this manner, it is unnecessary to mark or determine vertical support post 12 spacing in that the spacing is established by the distance between each of the securing locations 30, 32. In addition, each upper securing location 30 corresponds to a lower securing location 32, with the larger diameter opening 22 of the lower bracket 16 corresponding to the smaller diameter opening 26 of the upper bracket 14, and the elongated slots 24 of the lower bracket 16, likewise, corresponding to the elongated slots 28 of the upper bracket 14. Each of these upper and lower elements correspond to one another and lie vertically planar with one another.

Each of the vertical upright support posts 12 includes a central elongated support element 34 and a pair of termination flanges 36 extending longitudinally parallel to the support elements 34. Pins 38 extend transversely from the elongated support element 34 at predetermined distances along the elements and secure the flanges 36 to the support elements 34. As such, each of the vertical support posts 12 is a vertical riser having a central support element 34 and a pair of flanges 36 extending parallel to and longitudinally along each of the elements 34 secured thereto by the pins 38. In a preferred arrangement, the riser or support element 34 has openings 40 formed therein through which the pins 38 traverse and are fastened to the flanges 38 and the support element 34 by, for example, welding.

Figure 2:
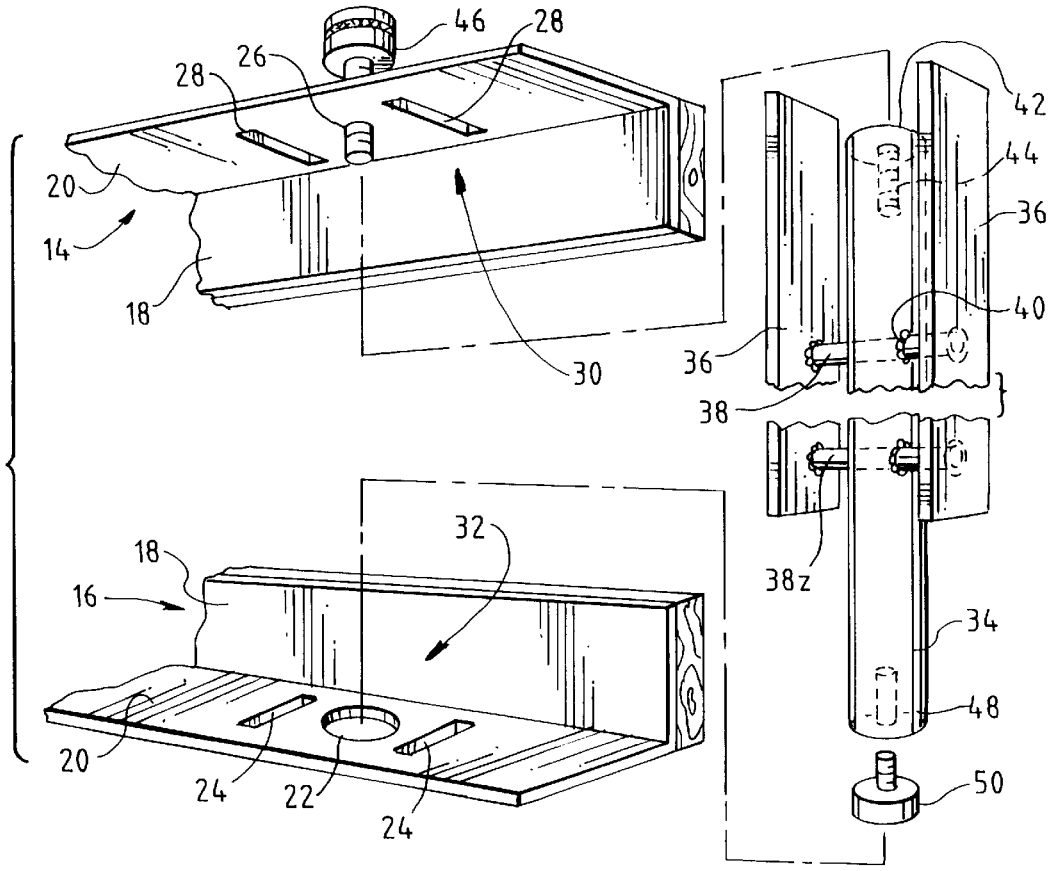
FIG. 2 is a partial exploded perspective view of one vertical upright support post, illustrated as the support post inserts into and secures to the upper and lower brackets.

Referring now to FIG. 2, the flanges 36 extend along each support post 12, at the top, to a position slightly beyond (i.e., above) that of the end 42 of the support element 34. That is, the flanges 36 extend upwardly beyond the end 42 of the support element 34. A threaded bore or insert 44 is formed in the top 42 of the support element 34 to facilitate securing the post 12 to the upper bracket 14. A knurled fastener or bolt 46 threads into the bore 44 to secure the post 12 to the upper bracket 14.

The lower end of the support post 12 is configured in a converse manner to the upper end. The elongated support element 34 extends beyond the lower end of the flanges 36, as shown generally at 48. In addition, the last transverse pin 38*z* that secures the flanges 36 to the support element 34 is spaced from the end of the flanges 36. In this manner, a portion of each of the flanges 36 extends beyond the last transverse pin 38*z* but not to the lower end of the support element 34. In a preferred arrangement, a height adjusting element 50, such as the exemplary threaded foot extends from the lower end of each support post 12. As will be explained in detail below, the threaded foot 50 permits fine adjustment of the height of the support post 12.

Figure 4:
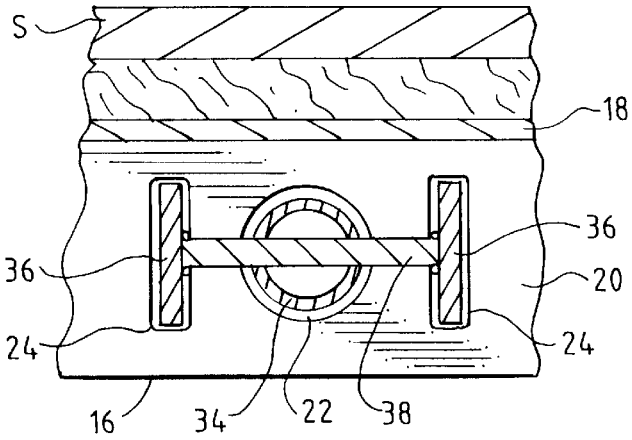
FIG. 4 is a partial cross-sectional view taken along line 4—4 of FIG. 1, and illustrates one exemplary vertical upright support post positioned within the lower bracket.

Referring to FIGS. 2 and 4, installation of the wall mounted display system 10 will be readily understood. First, the upper and lower brackets 14, 16 are secured to a surface S, such as a wall. The brackets 14, 16 can be secured to the wall S by mechanical fasteners, such as bolts, screws and the like, which mechanical fastening methods will be recognized by those skilled in the art. In securing the upper and lower brackets 14, 16 to the wall S, the brackets 14, 16 must be secured parallel to one another and spaced a predetermined distance from one another. In addition, a desired distance of the lower bracket 16 from the floor F must also be carefully determined and maintained. In installing the brackets 14, 16, care must also be taken to assure that corresponding upper and lower securing locations 30, 32 are vertically aligned with one another. Essentially, the upper and lower brackets 14, 16 must be parallel to and properly spaced from one another, with the lower bracket 16 properly spaced from the floor F. In addition, corresponding upper and lower securing locations 30, 32 must be vertically aligned with one another.

After the upper and lower brackets 14, 16 are properly located and secured to the wall S, the lower end of the vertical support post 12 is mounted to the lower bracket 16 by inserting the support element 34 through the larger diameter opening 22 in the lower bracket 16. While inserting the support element 34 through the opening 22, the lower ends of the flanges 36 are inserted into the elongated slots 24 located in the bracket 16 on either side of the opening 22.

With the lower portion of the support post 12 positioned in the lower bracket 16, the upper portion of the support post 12 is located and positioned in the upper bracket 14, by inserting the flanges 36 through the elongated slots 28 in the upper bracket 14. The fastener or bolt 46 is then inserted through the smaller diameter opening 26, and is threaded into the bore 44, securing the support post 12 in place. As seen in FIG. 1, when the support post 12 is in place in the brackets 14, 16, it is spaced from the wall S.

The threaded foot 50 is next adjusted by lowering it to rest on the floor F, which transfers any vertical load exerted on the support post 12 to the floor F, rather than on the brackets 14, 16. The remaining support posts 12 are installed between the upper and lower brackets 14, 16 in a similar manner. The threaded foot 50 can be further used to provide fine height adjustment of each support post 12, to assure that each of the transverse pins 38 is on a horizontal plane with corresponding pins 38 of each adjacent support post 12. The threaded foot 50 is also used to adjust post 12 height to assure that spanning elements, such as shelves that extend between support multiple support posts 12, are horizontally oriented and not skewed.

Figure 5:
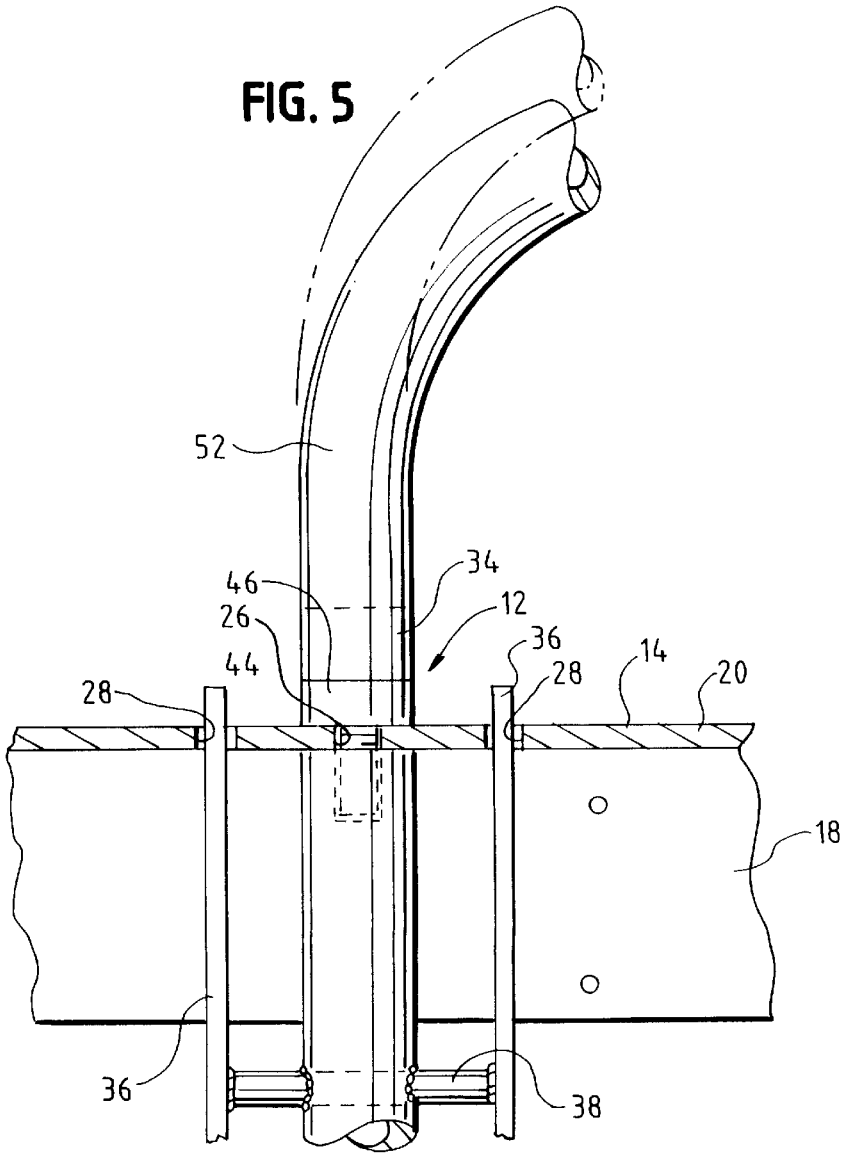
FIG. 5 is a partial cross-section view taken along line 5—5 of FIG. 1, illustrating an exemplary semi-circular header element mounted to the top portion of a vertical upright support post.

A wide variety of product display elements and display ornamentation can be supported from the wall mounted display system 10. For example, as shown in FIGS. 1 and 5, a semi-circular header portion 52 can be used to extend between a pair of adjacent support posts 12. The semi-circular header 52 can be fitted directly into the threaded bore 44 of the support posts 12 or can attach to the bolt 46 using any of a variety of mechanical fastening arrangements.

Figure 3:
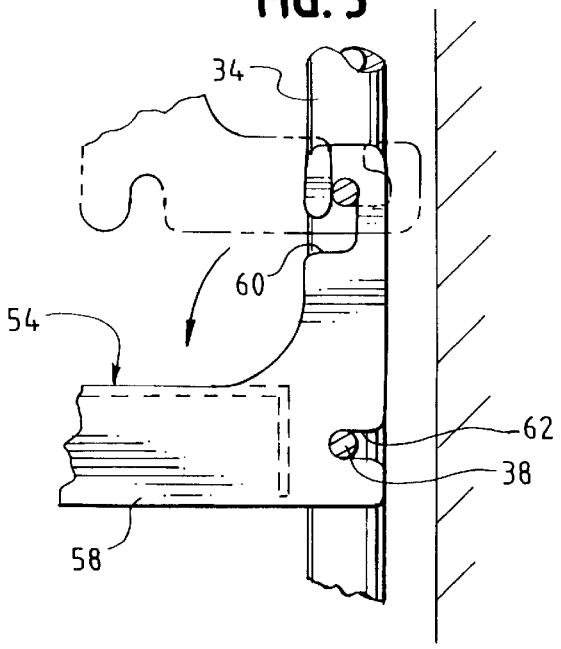
FIG. 3 is a partial cross-sectional view taken along line 3—3 of FIG. 1, and illustrates an exemplary shelf bracket being positioned on one of the vertical upright support posts.

The display system 10 can also support shelves 54 and hangers 56 as illustrated in FIGS. 1 and 3. FIG. 3 illustrates one exemplary arrangement by which a shelf bracket 58 or hanger bracket attaches to the support post 12. The bracket 58 can include a pair of opposingly oriented notches 60, 62 formed in the bracket 58. An upper notch 60 can be formed having an L-shaped opening to lock the notch 60 onto the transverse pins 38. One advantage of the present display system 10 is that the end flanges 36 which are affixed to the pins 38, prevent the bracket 58 from slipping or otherwise dislodging from the pins 38. This additional, lateral securing arrangement provides increased assurance of the structural integrity of the display system 10 and the supported structural elements (e.g., product display elements) that are attached to the system 10, such as shelves 54, hangers 56 and the like. The hanger element 56 secures to the display system 10 in a like manner, and can be used to, for example, hang garments and the like for display.

Other display elements can include, for example, a partition 64 extending from the display system 10, transversely from the wall S. Such a partition 64 can be used to segregate or separate different merchandise or, for example, different sizes of the same merchandise.

Figure 6:
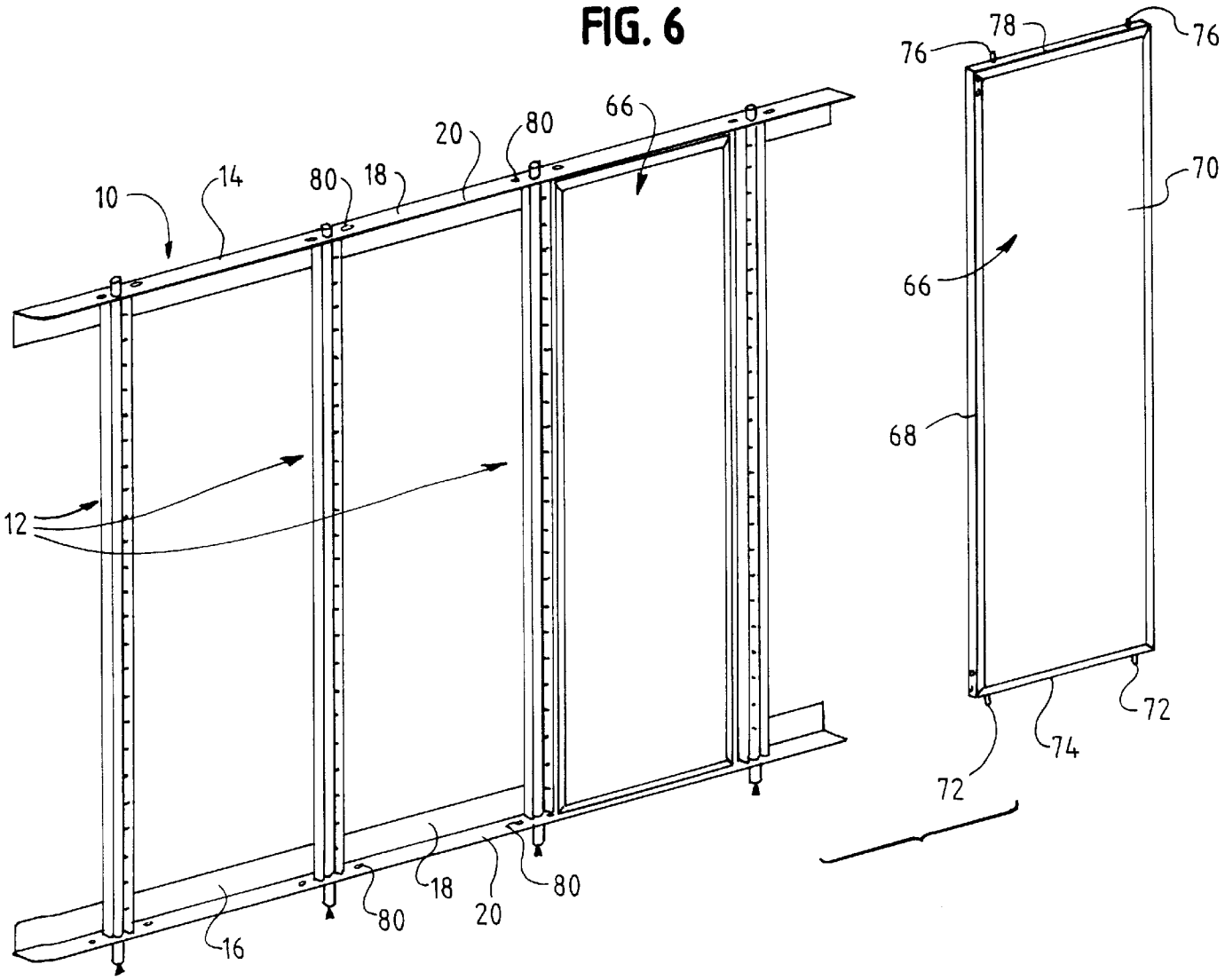
FIG. 6 is a partial perspective view of the wall mounted display system illustrated with an optional wall panel positioned between the upper and lower brackets and between adjacent support posts.

An additional display element includes a wall panel 66 that secures to the upper and lower brackets 14, 16 between adjacent vertical support posts 12, as illustrated in FIG. 6. The panel 66 can be formed having a frame 68 and a central core (not shown) interposed between face sheets 70 (one shown). The face sheets 70 can be formed having different colors or graphics, or can be mirrored, depending upon the design and ornamentation that is desired. In one embodiment, the frame 68 includes fixed lower pins 72 extending from a bottom edge 74 of the frame 68 and biased (e.g., spring-loaded) upper pins 76 extending from an upper edge 78 of the frame 68. The pins 72, 76 insert into openings 80 formed in the upper and lower brackets 14, 16 to secure the panel 66 to the display system 10. The panels 66 provide added flexibility and design potential for the display system 10.

Figure 12:
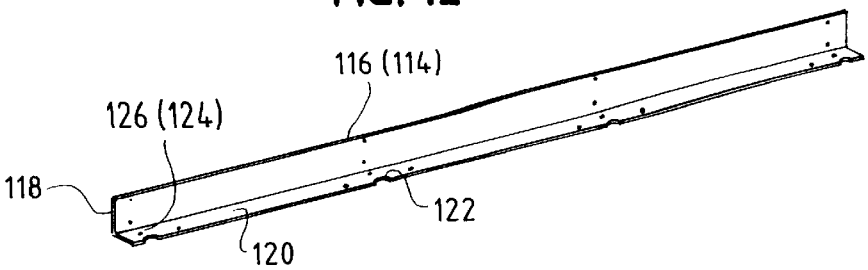
FIG. 12 is a perspective view of a bottom or lower bracket; the upper bracket being identical thereto and inverted when mounted to an adjacent surface.

Another embodiment of the display system 110 is illustrated in FIGS. 7–17. In this embodiment, the system 110 can be erected as a wall-mounted system or as a free-standing system, commonly referred to as a gondola-type system. This system 110 includes generally parallel, vertically extending upright posts 112. When used as a wall-mounted system, the posts 112 are secured between and mounted to upper and lower brackets 114, 116, respectively. The brackets 114, 116 are adapted to secure the vertical support posts 112 in spaced parallel relation to one another. FIG. 12 illustrates the brackets 114, 166. It is to be noted that FIG. 12 shows a lower bracket 116, and the upper bracket 114 is merely inverted from that shown.

The upper and lower brackets 114, 116 are angle-like members each having a first leg 118 for mounting the bracket 114, 116 to the wall surface and a second leg 120 that is configured for receiving the vertical support posts 112. Preferably, a semicircular notch 122 is formed in the second leg 120 at about the location at which each support post 112 is mounted to the brackets 114, 116. The second leg 120 of each of the upper and lower brackets 114, 116 includes holes or openings 124, 126 formed therein for receipt of fasteners not shown and for receipt of aligning pins 130 on the posts 112, as will be discussed in more detail below.

Figure 7:
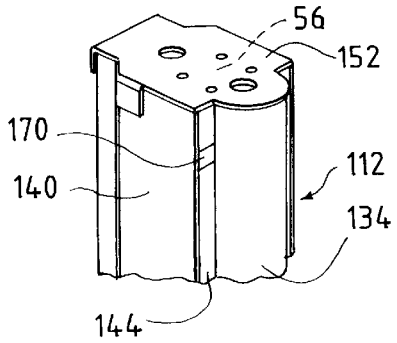
FIG. 7 is a partial perspective view of an alternate embodiment of a vertical sub-port post in accordance with the principles of the present invention.
Figure 8:
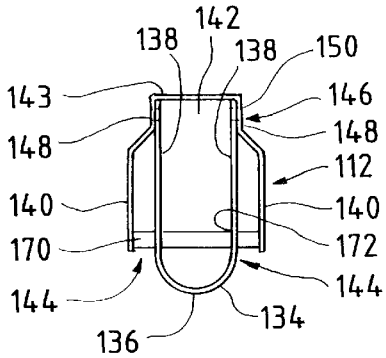
FIG. 8 is a cross-sectional view of the support post of FIG. 7 taken through a transverse pin.
Figure 9:
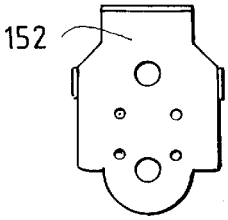
FIG. 9 is a top view of the support post of FIG. 7.
Figure 10:
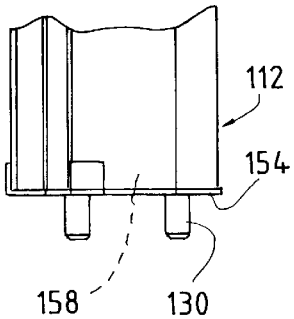
FIG. 10 is a partial side view of a bottom end of the support post of FIG. 7.
Figure 11:
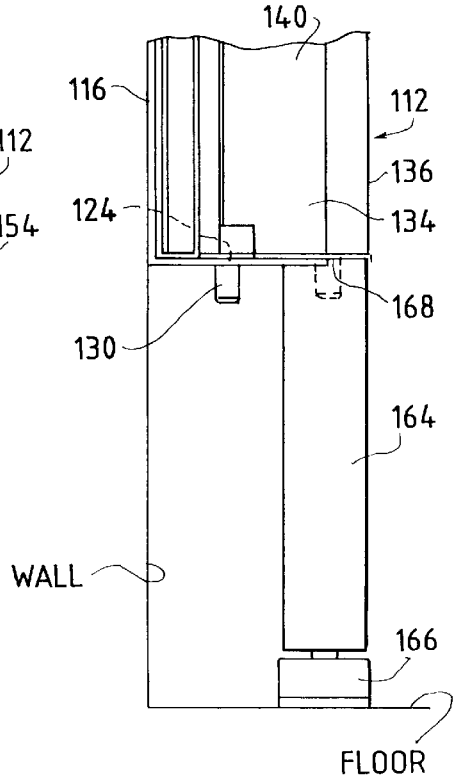
FIG. 11 illustrates a bottom end of the support post illustrating the support post resting on a bottom or lower bracket and further illustrating a support tube extending to the floor aligned with the bottom end of the support posts.

Each of the vertical upright support posts 112, as best seen in FIGS. 7–8, includes a central elongated U-shaped support element 134 having a rounded central portion 136 and a pair of elongated generally planar leg portions 138. Each support post 112 further includes a pair of support flanges 140 that extend from an open end 142 of the U-shaped support member 134 toward the rounded center 136. The support flanges 140 extend in a generally parallel, spaced relation to the elongated legs 138 of the support element 134. In this manner, as indicated at 144, a gap is formed between each of the support flanges 140 and its respective support element let 138. In a most preferred embodiment, the support flanges 140 are formed as a unitary member, indicated at 146, and are connected to one another across the open end 142 of the U-shaped support element 134 by a connecting member 143, thus, enclosing the open end 142 of the element 134. The flange assembly 146 includes first and second securing walls 148, that are positioned outwardly of and abutting the U-shaped support element 134 at about the open end 142 thereof. Fasteners 150, such as rivets, secure the U-shaped support element 134 and flange assembly to one another.

The support posts 112 include upper and lower caps 152, 154, respectively, that essentially cover the top and bottom open portions 156, 158 respectively, of the U-shaped support member/flange assembly 134/146. The caps 152, 154 can include openings 160 therein and each can further include one or more of the aligning pins 130 extending therefrom that is configured for receipt in one of the openings 124 in the upper and lower brackets 114, 116, respectively, to maintain the support post 112 in a vertical orientation and in a predetermined position along the upper and lower brackets 114, 116.

Extending from the lower end of support post 112, below the lower bracket 116, the system 110 can include a support element 164, such as a structural tube that extends to the floor and includes, for example, a leveler 166 to transfer any load that may be exerted on the system to the floor. The support tube 164 can include an opening 168 in the top thereof configured to receive the front pin from the support post cap. As will be recognized by those skilled in the art, the leveler, 166 which is typically a threaded "foot" can be used to level the support post 112 and assure that as much load as possible is shifted from the display system 110 to the floor.

As in the embodiment 10 illustrated in FIGS. 1–6, this embodiment of the display fixture system 110 includes a plurality of pins 170 that extend transversely through the elongated supported element 134 at predetermined distances along the element 134. In this embodiment, the pins 170 are received in openings 172 that are formed in each of the elongated leg portions 138. The pins 170 are maintained in position by "capture" between the flanges 140. In this manner, each of the pins 170 does not have to be secured to the support element 134 or flange assembly 146. Rather, the position of the flanges 140 relative to one another maintains the pins 170 in position along the post 112. It may, however, be desirable to secure one or more of the pins 170 to one of the flanges 140 and/or support element 134 at various locations along the support post 112.

Also as with the earlier embodiment 10, a wide variety of product display elements 174 and display ornamentation can be supported from the support posts 112 from the pins 170.

Referring to FIG. 13, the present system 110 can also be used as a free-standing or gondola-type system. In this configuration, two support posts 112 are mounted to one another with the rear portion 176 of the flange assemblies 146 abutting and affixed to each other. As seen in FIG. 14, in such an arrangement, the upper 152 and lower (not seen) post caps can be configured as a single cap to extend between the pair of "back-to-back" support posts 112. In this configuration, rather than upper and lower wall-mounted support brackets, the system uses a series of base elements 178 and top elements 180 to secure the support posts 112 to one another. The base elements 178 include a plurality of openings 182 to, for example, receive fasteners (not shown), or the aligning pins 130 to secure the support posts 112 to the base elements 178.

In like manner, the top elements 180 extend between the upper ends of each of the support posts 112 to secure the posts 112 to one another and to maintain spatial relationship between the support posts 112, thus maintaining the support posts 112 vertical and parallel to one another. The top elements 180 can include interlocking 190 notches and projections 192 to secure the tops to one another.

In a most preferred embodiment, an "end-cap" as illustrated at 186 is used at the end of a run of the display wall and is mounted perpendicular thereto. The end cap 186 provides additional support to the overall structure. This is particularly desirable in that this structure can be used as a free-standing display. The end-cap 186 is configured in like manner to the remaining portions of the display 110.

In a most preferred embodiment, channels 188 are mounted to the support flange assemblies 146 as best seen in FIG. 14. These channels 188, which face cooperating channels 188 adjacent facing support posts 112, can be used to receive, for example, the display elements 174 or other type of panel that can include graphics, indicia or other aesthetic elements.

Those skilled in the art will recognize the extreme advantages of the present wall mounted display system 10, 110. The present system 10, 110 provides a readily designed, easily installed and extremely versatile display system 10, 110 that can be used for displaying a wide variety of merchandise. In addition, the present display system 10, 110 also provides for easily installing shelving, hangers, desk tops and other product display elements and ornamentation to create custom display arrangements.

From the foregoing it will be observed that numerous modifications and variations can be effectuated without departing from the true spirit and scope of the novel concepts of the present invention. It is to be understood that no limitation with respect to the specific embodiments illustrated is intended or should be inferred. The disclosure is intended to cover by the appended claims all such modifications as fall within the scope of the claims.

What is claimed is:

1. A display fixture system for mounting to an associated surface comprising:

upper and lower spaced apart, parallel horizontal brackets for mounting to the surface, each bracket having a securing location corresponding to a securing location of the other of the pair of brackets, the brackets being mounted to the surface so that corresponding securing locations are vertically aligned with one another; and a support post extending between and secured to the brackets, the post being secured between the brackets in a vertical orientation, transverse to the brackets and spaced from the surface, the support post including a support element and a plurality of pins traversing through the support element, the support post including a pair of flanges affixed to the support element, each flange extending along a side of the support element and configured to maintain the pins positioned within the support post, the support post capable of supporting a product display.

2. The display fixture system in accordance with claim 1 wherein the support element is a U-shaped member having a pair of elongated leg portions and defining an open end, and wherein the pair of flanges are connected to one another by a connecting portion that extends across the open end of the support element, the flanges being affixed to the support element at about the open end of the support element.

3. The display fixture system in accordance with claim 2 wherein each flange has a portion spaced from and parallel to its respective support element leg portion.

4. The display fixture system in accordance with claim 3 wherein each support post includes a first pin extending from a top thereof and a second pin extending from a bottom thereof and wherein the upper and lower brackets each include openings therein, the upper and lower bracket openings corresponding to one another and configured for receipt of the support post first and second pins to maintain the support post in a vertical orientation.

5. The display fixture system in accordance with claim 4 wherein the support post includes an upper end cap and a lower end cap and wherein the first and second pins extend from the upper and lower end caps, respectively.

6. The display fixture system in accordance with claim 1 including a support element aligned with a lower end of the support post and extending from the lower bracket to an adjacent, associated floor surface.

7. A display fixture system, comprising:

a plurality of vertical support posts, each support post including a U-shaped support element and a plurality of pins traversing through the support element, each support post including a pair of flanges connected to one another by a connecting portion, each flange extending along a side of the support element, each support post further including a plurality of pins traversing through the support element, wherein the flanges extend along outer sides of the support element and are configured to maintain the pins positioned within the support posts, and wherein at least some of the support posts are in pairs in back-to-back relation to one another, the support posts defining a support post plane;

at least one base element configured to receive a bottom portion of the support posts;

at least one top element configured to receive a top element of each of the support posts; and at least one end section connected to the plurality of support posts perpendicular to the support post plane.

8. The display fixture system in accordance with claim 7 wherein the support posts include channels therein adapted to receive associated display media oriented perpendicular to the support post plane.

9. The display fixture system in accordance with claim 7 wherein each pair of back-to-back support posts includes a top cap configured to extend across the top portion of the support post pair and wherein the top cap includes pins extending therefrom adapted to be received in the at least one top element.

* * * * *